US006823563B2

(12) United States Patent
Robinson et al.

(10) Patent No.: US 6,823,563 B2
(45) Date of Patent: Nov. 30, 2004

(54) REMOVABLY ATTACHABLE COVER HANDLES FOR ELECTRIC POWER WATTHOUR METER

(75) Inventors: Darrell Robinson, Highland, MI (US); Allen V. Pruehs, Howell, MI (US)

(73) Assignee: Ekstrom Industries, Inc., Farmington Hills, MI (US)

( * ) Notice: Subject to any disclaimer, the term of this patent is extended or adjusted under 35 U.S.C. 154(b) by 18 days.

(21) Appl. No.: 10/227,973

(22) Filed: Aug. 26, 2002

(65) Prior Publication Data

US 2004/0040119 A1 Mar. 4, 2004

(51) Int. Cl.[7] ..... A45C 13/22

(52) U.S. Cl. ..... 16/422; 16/443; 16/423; 16/425

(58) Field of Search ..... 16/422, 423, 425, 16/443, 406; 403/353, 354; 429/187; 361/664, 665, 667; 439/517; 292/347, DIG. 8, DIG. 12; 70/389

(56) References Cited

U.S. PATENT DOCUMENTS

| | | | | | |
|---|---|---|---|---|---|
| 2,468,351 | A | | 4/1949 | Vail | |
| 3,044,158 | A | | 7/1962 | Bushnell | |
| 3,120,639 | A | | 2/1964 | Pfeffer | |
| 3,133,247 | A | | 5/1964 | Sherman | |
| 3,197,848 | A | | 8/1965 | Eichacker | |
| 3,322,380 | A | | 5/1967 | Affel et al. | |
| 3,591,835 | A | * | 7/1971 | Sloop | 361/672 |
| 3,594,696 | A | | 7/1971 | Witek, Jr. | |
| 3,934,326 | A | | 1/1976 | Owen et al. | |
| 4,019,135 | A | | 4/1977 | Lofdahl | |
| 4,115,021 | A | * | 9/1978 | Loch | 403/353 |
| 4,115,835 | A | | 9/1978 | Doby | |
| 4,121,495 | A | * | 10/1978 | Malo et al. | 411/351 |
| 4,122,599 | A | | 10/1978 | Lunycz | |
| 4,281,888 | A | | 8/1981 | Seaman | |
| 4,323,294 | A | | 4/1982 | Robinson | |
| 4,352,324 | A | * | 10/1982 | Noh | 99/425 |
| 4,491,789 | A | | 1/1985 | Benbow | |
| 4,907,334 | A | | 3/1990 | Carver | |
| 5,094,540 | A | * | 3/1992 | Face, Jr. | 366/46 |
| 5,097,581 | A | | 3/1992 | Williams et al. | |
| 5,361,026 | A | | 11/1994 | Pruehs et al. | |
| 5,444,907 | A | | 8/1995 | Becker | |
| 5,503,271 | A | | 4/1996 | Lynch | |
| 5,514,959 | A | | 5/1996 | Horan et al. | |
| 5,767,790 | A | | 6/1998 | Jovellana | |
| 5,992,717 | A | * | 11/1999 | Clewes et al. | 224/251 |
| 6,117,588 | A | * | 9/2000 | Campbell et al. | 429/187 |
| 6,280,805 | B1 | | 8/2001 | Markovich | |
| 6,353,971 | B1 | * | 3/2002 | Krawczyk | 16/412 |
| 6,520,798 | B1 | | 2/2003 | Robinson | |

* cited by examiner

*Primary Examiner*—Chuck Y. Mah
(74) *Attorney, Agent, or Firm*—Young & Basile, PC

(57) ABSTRACT

A handle adapted to be mounted on a watthour meter cover facilitates movement of the watthour meter relative to a meter socket. The handle is removably attachable to a handle receiver carried on the cover, with the handle defining a finger grip surface. The receiver is in the form of one or more recesses or projections which are engagable with complimentary portions on the handle.

26 Claims, 8 Drawing Sheets

REMOVABLY ATTACHABLE COVER HANDLES FOR ELECTRIC POWER WATTHOUR METER

BACKGROUND

Electrical power is supplied by an electric utility to individual use sites by power line conductors which extend from the utility poles to a meter socket mounted on a convenient surface at the use site. The power line conductors are physically connected to line jaw contacts in the meter socket. Distribution conductors extend from load jaws mounted in the socket throughout the use site.

An electric power watthour meter is provided for measuring the power consumed by a use site by measuring the current drawn by the use site from the line to the load conductors. A watthour meter typically has a base on which metering components are mounted. Blade terminals extend from the base for interconnection in the socket line and load jaw contacts so as to place the meter in series between the power line conductors and the power load conductors. A dome historically formed of glass surrounds the electromechanical components mounted on the watthour meter base. The dome includes a mounting flange having slots which engage mating projections on the base so as to lock the dome to the base when the dome is rotated 10° after connection to the base. A seal or key is used to then lock the dome to the base.

With the advent of electronic meters and automatic meter reading equipment, the glass dome has been replaced with a plastic dome or cover typically having a view window in an end wall for viewing an electronic display of power consumption. The plastic domes are still formed with a mounting flange with slots for engagement with a standard meter base carrying the blade terminals and metering components.

The watthour meter is installed in the socket and/or a socket adapter or socket extender mounted in the socket which also carries mating jaw contacts by inserting the meter blade terminals into the meter socket or socket adapter jaw contacts.

Although watthour meters typically remain in place for many years without removal, it still becomes necessary from time to time to remove the meter for accurately testing, repair, replacement or to add additional functionality to the meter socket or watthour meter itself. The smooth, tapered, cylindrical shape of the watthour meter dome or cover makes it difficult to pull the meter from the socket. The dome itself would be a convenient place for a utility service person to grasp the meter and exert a pull-out force as the utility person would like to keep his or her fingers away from the meter mounting base which is generally in close proximity to the live power conductors and jaw contacts in the meter socket. However, heretofore there has been no convenient surface on a watthour meter dome for easy grasping by the utility service person to facilitate removal with low pull-out forces. Thus, it would be desirable to provide a watthour meter which is designed to facilitate easy removal from a meter socket or socket adapter.

When a watthour meter is installed in a meter socket or meter socket adapter mounted in a meter socket, it is critical that the meter line blades be properly oriented for insertion into the meter socket or meter socket adapter line jaw contacts. However, existing watthour meter domes have a round shape which lacks any external visual or tactile indication of a top point or portion of the meter which would insure that the line blades are properly orientated for engagement with the line jaw contacts in the meter socket or meter socket adapter. Without such visual or tactile indication, it is possible for the utility serviceperson to inadvertently insert the meter 90° out of normal mounting orientation into the meter socket. This places the one line blade terminal and one load blade terminal of the watthour meter in a direct short position across the meter socket or meter socket adapter line jaw contacts. Such an electrical fault can cause injury to the utility serviceperson and/or damage to the meter socket as a result of a typically explosive short circuit at full line power.

It is also possible for the utility serviceperson to insert the meter 180° out of normal mounting orientation into the meter socket or socket adapter. This places the meter in a mounting condition which causes the meter to run backwards thereby subtracting power. Indeed, this is common method of stealing electric power.

These mounting problems are exacerbated in the case of electronic meters which still have a round cross section; but are usually formed with an opaque cover which thereby eliminates any possibility of viewing the internal meter components to determine the proper orientation of the meter for installation in a meter socket or socket adapter. Even the display in such electronic meters is off or blank until the meter is installed in the socket such that the display cannot any visual indication of proper meter mounting orientation during installation.

It is also known to provide an attachable handle to a watthour meter to facilitate removal of the watthour meter from a meter socket. Such a handle requires a complicated attachment mechanism which secures the handles to the meter base flange or via a strap to the cover itself. Such attachable meter handles are difficult to use, have a complicated and therefore costly construction, and still provide only an insecure attachment at best.

Thus, it would be desirable to provide a handle which is releasably attachable to a meter cover to facilitate meter removal from a meter socket or meter socket adapter. It would also be desirable to provide a releasably attachable handle for a meter cover which does not interfere with the cover or meter operation. It would also be desirable to provide a releasably attachable handle for a meter cover which can be easily attached and removed from the cover when not in use. It would also be desirable to provide a releasably attachable handle for a watthour meter cover which does not significantly enlarge the meter cover volume.

SUMMARY

The present invention is a cover for a watthour meter which has a handle removably attachable thereto to facilitate low pull-out force removal of the watthour meter from a meter socket or meter socket adapter.

The present invention also is a watthour meter having a cover with unique removably attachable handles.

The unique removably attachable cover handle of the present invention provides significant advantages in terms of facilitating easy removal and, in some aspects, installation of a watthour meter, from or to a watthour meter socket or socket adapter mounted in a watthour meter socket. The handle provides a convenient gripping surface for easy pull-out force application to separate the meter from the meter socket or socket adapter. At the same time, the handle does not interfere with the normal function of the cover or viewing of power consumption readout displays through the end wall of the cover.

The removably attachable cover handle according to the present invention addresses a long time problem encountered with the use of watthour meters which lack a convenient surface to facilitate easy, pull-out from a meter socket or meter socket adapter. According to the present invention, the handles or gripping surface is easily attachable to the meter cover to enable a utility serviceperson to easily grasp the cover handle and exert a smooth pull-out force to separate the meter from the meter socket or socket adapter jaw contacts.

The cover handle of the present invention may also be used to increase the installation safety of a watthour meter in a meter socket or socket adapter since selected aspects of the handle receiver, when mounted on the cover at a top or upper position to indicate the normal mounting orientation of the watthour meter in a meter socket, insure that the watthour meter line and load blade terminals are properly aligned with the corresponding line and load jaw contacts in the meter socket or socket adapter. Specifically, the mounting of the handle of the present invention at a position on the cover which would indicate visually as well as tactally the normal top of the watthour meter when the watthour meter is in its normal mounting orientation with respect to the meter socket jaw contacts, can provide a standardized indication of proper meter orientation prior to installation in the meter socket or socket adapter. This increases installation safety by minimizing the possibility of a 90° our of orientation mounting of the watthour meter in the meter socket which can cause a dangerous electric fault. This also minimizes the possibility of mounting the watthour meter 180° out of normal mounting orientation in a meter socket which is the common method used to steal unmetered electric power.

BRIEF DESCRIPTION OF THE DRAWING

The various features, advantages and other uses of the present invention will become more apparent by referring to the following detailed description and drawing in which.

DETAILED DESCRIPTION

Figure 1:
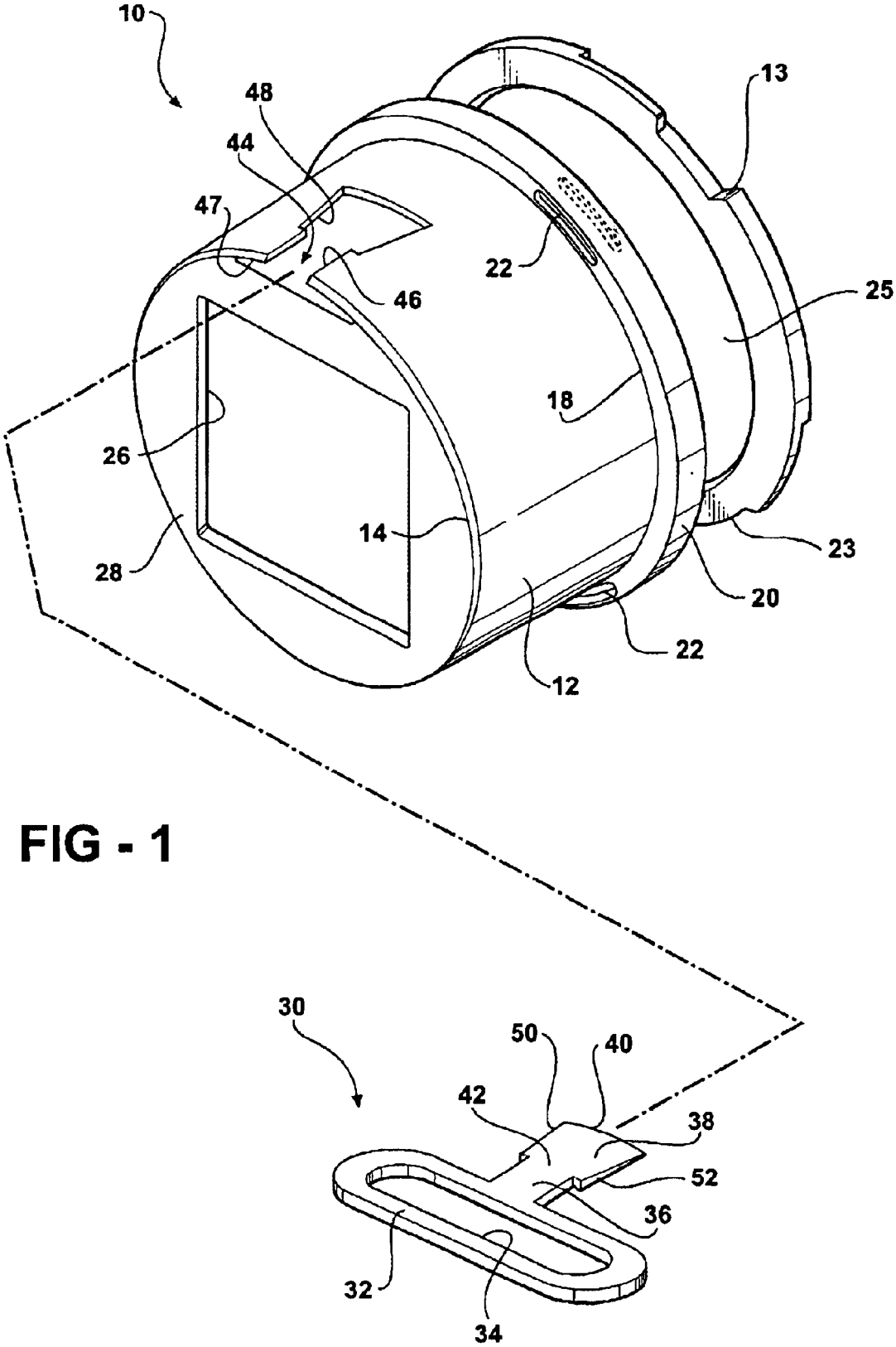
FIG. 1 is an exploded perspective view of a watthour meter cover handle apparatus constructed in accordance with one aspect of the present invention.

Referring now to the drawings, there is depicted a watthour meter cover or dome which has unique removably attachable handle apparatus to facilitate the removal of the watthour meter from a meter socket.

As shown in FIG. 1, the meter cover or dome, both hereafter refer to simply as the "cover", is typically formed of a one piece body 10 of a suitable material, preferably a plastic, such as polycarbonate, for example. The cover 10 includes a generally cylindrical sidewall 12 which tapers from a first, smaller diameter end 14 to an opposed larger diameter second end 16. A radially extending flange 18 projects from the second end 16 of the sidewall 12 and terminates in a longitudinally extending rim 20.

As is conventional, a plurality of circumferentially spaced slots 22 are formed in the flange 18 for engagement with mounting projections 23 on a watthour meter base 25. As is conventional, the rim 20 and flange 18 of the cover 10 are inserted over the base 25 with the slots 22 aligned with the meter base projections 23. The meter cover 10 is then rotated 90° to lock the cover 10 to the base 25. A key, not shown, is typically inserted through the cover 10 into the base 25 to lock the cover 10 to the base 25.

The use of the rim 20 and flange 18 on the cover which are rotated into engagement with the base of a meter is by way of example only. As shown pictorially in FIG. 1, the watthour meter includes a base 25 having projections 23 spaced circumferentially around one surface for rotational engagement with the slots 22 on the cover 10. Not shown in FIG. 1 are metering components which may take any suitable metering form, such as electromechanical rotating disk-type metering components as well as electronic metering circuits.

Other means for attaching the cover 10 to the base 25 may also be employed. Such means may not make use of the rotationally interconnected projections 23 and slots 22, but rather use other types of fastening means to secure the cover 10 to the base 25. Such alternate attachment configurations may also not require the flange 18 on one end of the cover 10.

As shown in FIG. 1, an optional aperture 26 is formed in a solid end wall 28 at the first end 14 of the cover 10. The aperture 26 which is typically closed by a display mounted on the meter base allows external viewing of the power consumption numeric outputs on the display as is conventional in electronic or automatic meter reading watthour meters. Alternately, the optional aperture 26 can be replaced by forming at least the end wall 28 or the entire cover 10 from a transparent plastic.

By way of further background, the assembled watthour meter, including the cover 10 and the base 25, are mounted in engagement with jaw contacts in a watthour meter socket or a watthour meter socket extender or socket adapter mounted in a meter socket. Blade terminals, not shown in FIG. 1, project exteriorly from an exterior surface of the base 25 into engagement with the jaw contacts in the socket adapter and/or socket so as to place the watthour meter in series with the utility power line conductors and the distribution load conductors, each also connected to the socket jaw contacts.

Since accurate power consumption measurement requires a secure electrical connection between the watthour meter blade terminals and the socket jaws, the socket jaws and/or the socket adapter jaws, are typically formed to have a high blade terminal retention force. This retention force, translates to a high watthour meter pull-out force.

In order to facilitate the removal of the watthour meter from a socket and/or watthour meter socket adapter, the present invention provides a unique handle means which are removably attachable to the cover 10.

In one aspect of a removable handle apparatus shown in FIG. 1, a handle 30 is formed of a grip portion 32 typically in the form of an elongated bar having a central aperture 34 for receiving the user's fingers. A generally planar stem 36 of constant cross-section projects from one side edge of the bar 32. A wedged shape receiver engagement member 38 projects from one end of the stem. The receiver engagement member 38 has a wedge shape wherein an outer end 40 has a wider width than an opposed inner end 42 adjacent to or connected to the stem 36.

In this aspect of the invention, a handle receiver 44 is formed in the cover 10 generally at the edge of the sidewall 12 and the end wall 14. The receiver 44 is in the form of a recess having a first width end 46 projecting longitudinally from the end wall 28 along one portion of the sidewall 12 and a larger width portion 48 inward of the first width portion 44. The sidewalls 47 forming the first and second width portions 46 and 48 taper inwardly in decreasing width from the innermost end of the second width portion 44 to the smaller width end at the end wall 28. The outer end portion of the smaller width end overhangs the lower inner edge.

In use, the wedge shaped end 38 of the handle 30 is inserted into the second width portion 48 of the recess 44. The handle 30 is then urged longitudinally outward with respect to the end wall 28 of the cover 10 bringing the side edges 50 and 52 of the wedge shaped end 38 into interfering engagement with the corresponding inward tapering sidewalls of the first width portion 46 of the recess 44. This tightly fixes the handle 30 in the recess 44 and enables the user to exert a pull-out force, which may include a rocking component, to remove the entire meter from a meter socket or meter socket adapter.

To release the handle 30 from the recess 44, the handle 30 is urged longitudinally toward the end wall 28 until the wedge-shaped end 38 moves into the second larger width portion 48 of the recess 44 which enables the wedge shaped end 38 and the stem 36 to be urged upward out of the recess 44.

Figure 2:
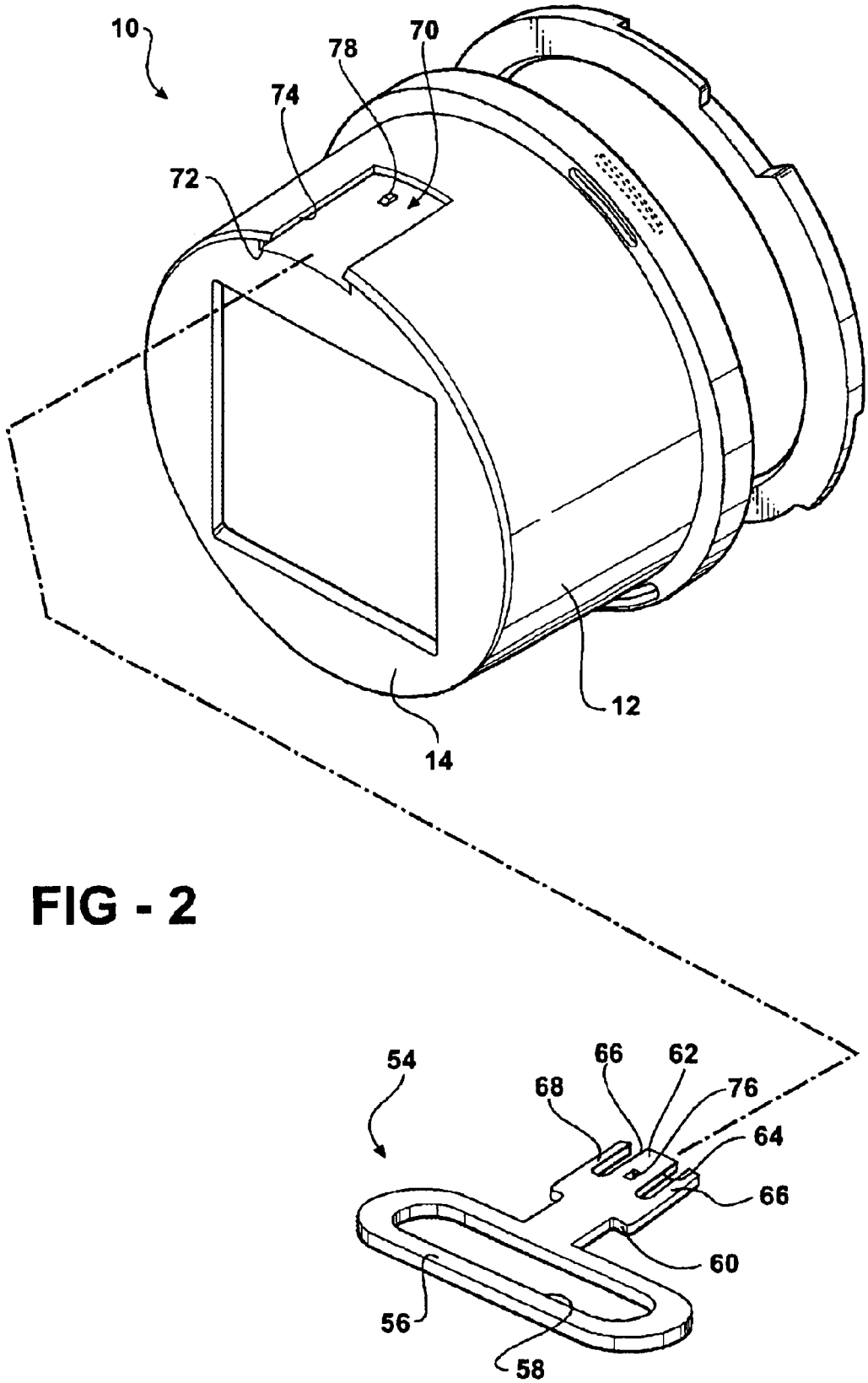
FIG. 2 is an exploded perspective view of another aspect of a watthour meter cover handle apparatus according to the present invention.

Another aspect of a removable handle apparatus 54 is shown in FIG. 2. The handle 54 includes a bar-like grip portion 56 having an internal aperture 58 for receiving the user's fingers. A generally constant diameter stem 60 projects from one side of the bar 56 and includes a central finger 62 which is spaced by slots 64 and 66 from laterally outward extending side fingers 66 and 68, respectively.

A handle receiver 70 includes an inverted T-shaped recess formed in the cover 10 extending longitudinally from the end wall 28 along one portion of the sidewall 12. Preferably, the recess, also denoted by reference number 70, is positioned at the top of the cover 10 when the cover 10 and the attached meter are in a normal, mounting position in a meter socket. The recess 70 has a larger width bottom portion 72 and a smaller width upper portion 74.

In use, the stem 60 of the handle 54 is inserted into the recess 70 with all of the fingers 62, 66 and 68 sliding into the larger width bottom portion 72 of the recess 70. Since the width of the bottom portion 72 is smaller than the nominal outside width between the outer side edges of the side fingers 66 and 68, the side fingers 66 and 68 are urged laterally inward toward the central finger 62 thereby forceably retaining the handle 54 in the recess 70.

The central finger 62 may be provided with an aperture 76 which is shaped complimentary to a projection 78 extending from the bottom portion of the sidewall 12 in the recess 70. Either the bottom edge of the central finger 62 or the end wall facing end of the projection 78 can be formed with a ramp or radiused surface to urge finger 62 upward and over the projection 78 until the projection 78 snaps into the aperture 76 in the finger 62. This engagement locks the handle 54 in the recess 70 for removal of the meter from a meter socket.

It will be understood that the aperture 76 may be formed as an inward extending closed recess in the sidewall 72 of the cover 10 and the complimentary projection formed on the central finger 62.

The handle 54 may be separated from the cover 10 by inserting a tool or a user's finger beneath the inner end of the central finger 62 which will be spaced a short distance from the inner end of the recess 70. The user exerts an upward force to disengage the central finger 62 from the projection 78 allowing the entire handle 54 to be slid outward from the recess 70.

Figure 3:
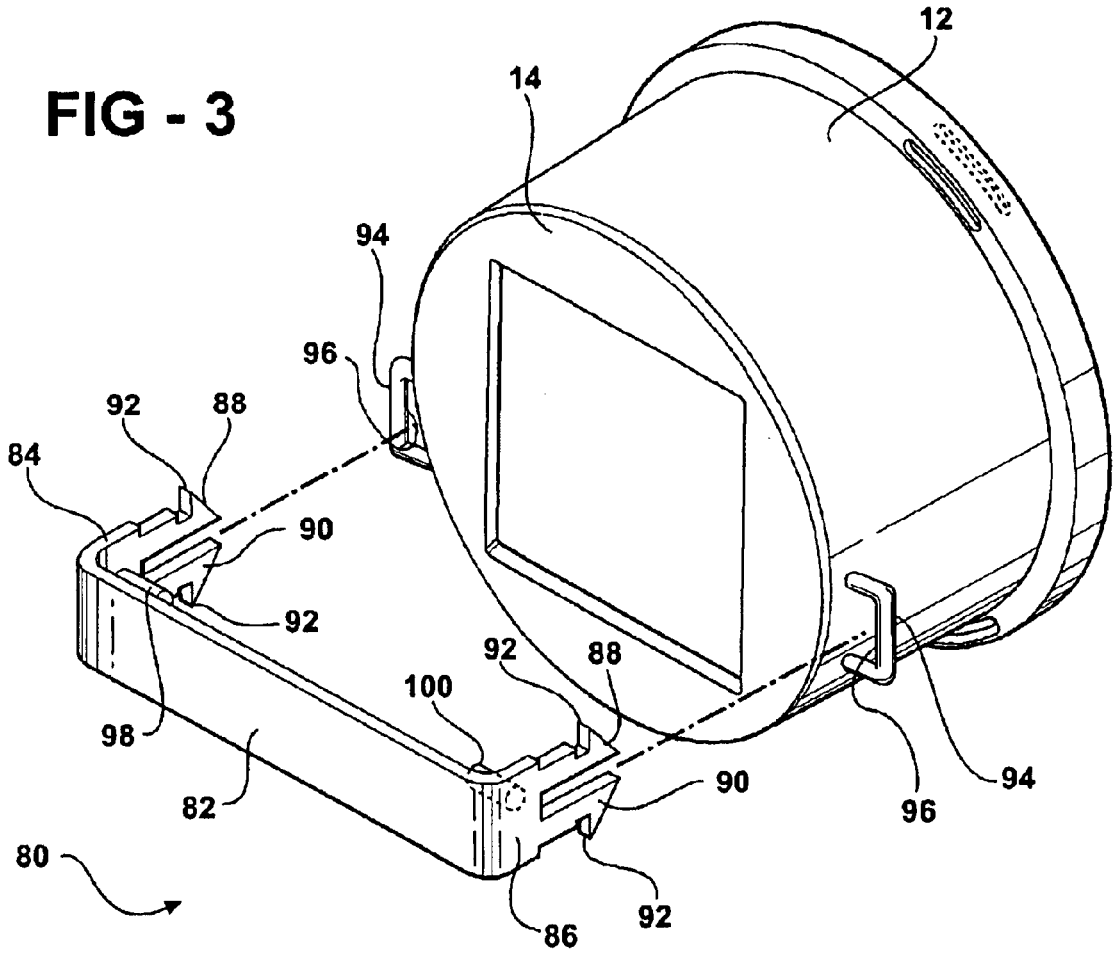
FIG. 3 is an exploded perspective view of yet another aspect of a watthour meter cover handle apparatus according to the present invention.
Figure 4:
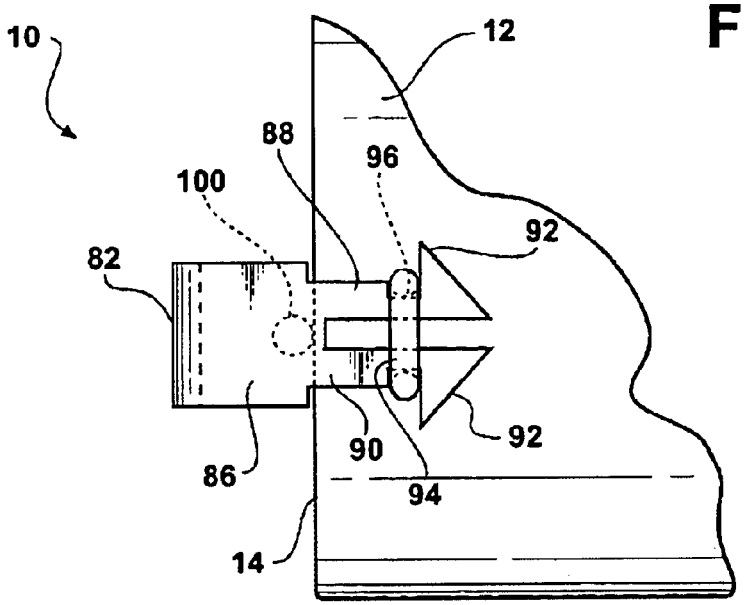
FIG. 4 is an enlarged, partial, side elevational view showing the interconnection of the handle and cover shown in FIG. 3.

Another aspect of the handle apparatus of the present invention is shown in FIGS. 3 and 4. In this aspect, the handle 80 has a bar-like grip 82 which is centrally located between two generally perpendicular extending side legs 84 and 86. The side legs 84 and 86 terminate in at least one and preferably a pair of spaced, resilient arms 88 and 90, each of which has a hook-shaped, enlarged end 92. Each pair of arms 88 and 90 has a certain amount of resiliency to enable the arms 88 and 90 to be urged toward each other as the handle 82 is inserted into a handle receiver on the cover 10.

The handle receiver is in the form of a pair of C-shaped bars 94 mounted on diametrically opposite sides of the sidewall 12 of the cover 10. A central portion of each bar 94 is spaced from the adjoining surface of the sidewall 12 to form an aperture 96 which is sized to receive the arms 88 and 90 of each of the side legs 84 and 86 of the handle 80.

During insertion, the arms 88 and 90 of each side leg 88 and 86 are urged toward each other until the hook-like ends 92 of each of the arms 88 and 90 clear the inner edge of the bar 94. The arms 88 and 90 then snap outward to their nominal position whereby the enlarged hook-like end 92 of the each of the arms 88 and 90 on each side leg 84 and 86 are positioned behind the side leg of the bar 94 locking the handle 80 to the cover 10.

In this position, at least one stop member 98 and 100 is respectively mounted on an inner surface of the side legs 84 and 86 to engage the end wall 14 of the cover 10. The stop members 98 and 100 act as a insertion stop limit for connection of the handle 80 to the cover 10 as well as placing a biasing force on the ends 92 of the arms 88 and 90 to retain the arms 88 and 90 in a latched position with the handle receiver bar 94.

Figure 5:
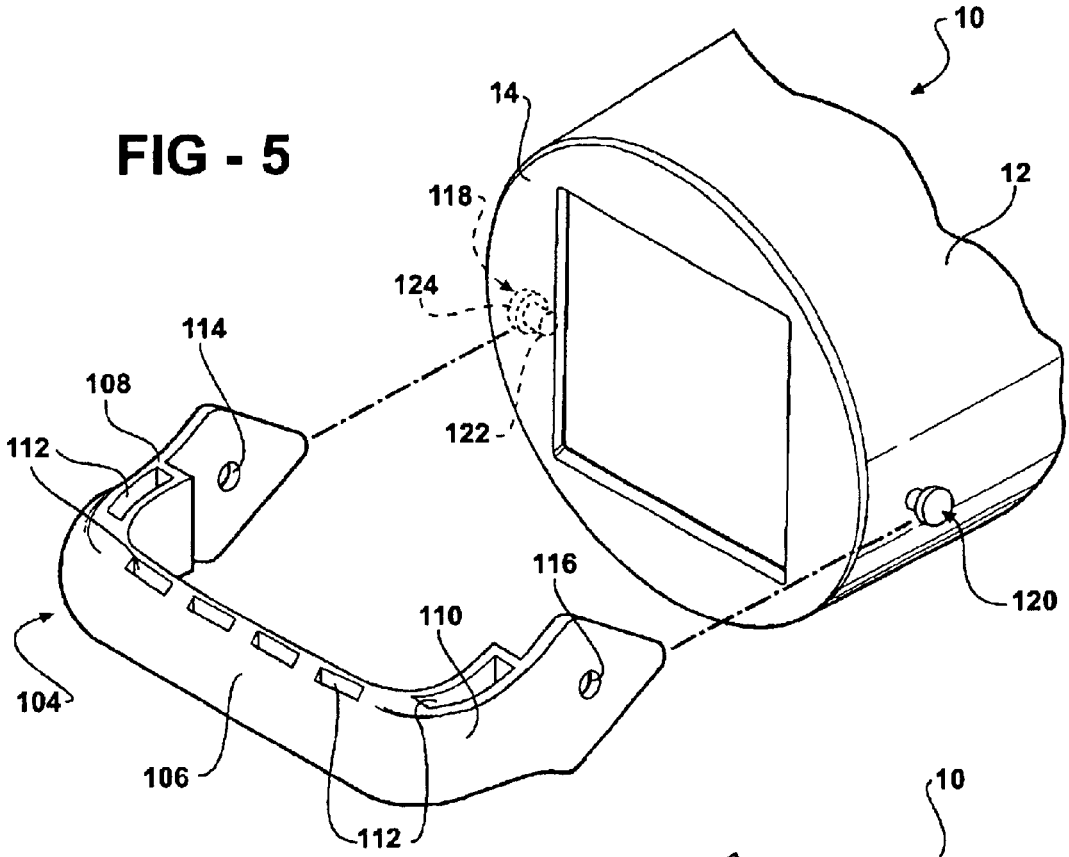
FIG. 5 is an exploded perspective view of yet another aspect of a watthour meter cover handle apparatus according to the present invention.

Another aspect of a meter cover handle apparatus according to the present invention is shown in FIG. 5. In this aspect, the handle 104 includes a central grip member 106 and a pair of angularly extending, resilient, side legs 108 and 110 which extend generally perpendicularly from opposite ends of the central grip 106. Weight and material reducing bores 112 are formed in the central grip 106 and the arms 108 and 110. Receiver engagement members 114 and 116, generally in the form of apertures in this aspect of the invention, are formed in the ends of the side legs 108 and 110.

The handle receiver is in the form of at least one and preferably a pair of diametrically opposed projections 118 and 120. Each of the projections 118 and 120 is an enlarged headed pin having a small diameter shank 122 and an enlarged head 124. The diameter of the apertures 114 and 116 is greater than the diameter of the enlarged head 124 of each projection 118 and 120 to enable the apertures 114 and 116 to slide over the heads 124 of each of the projections 118 and 120 during attachment of the handle 104 to the cover 10.

Once the apertures 114 and 116 pass over the enlarged heads 124, the apertures 114 and 116 will be disposed along the shank 122 of each projection 118 and 120. This removably attaches the handle 104 to the cover 10 and enables the user to exert a pull-out force on the handle 104 to separate the meter from the meter socket. To remove the handle 104 from the cover 10, the ends of the side legs 108 and 110 are pulled outward from the sidewall 12 until the apertures 114 and 116 clear the projections 118 and 120, respectively.

Figure 6:
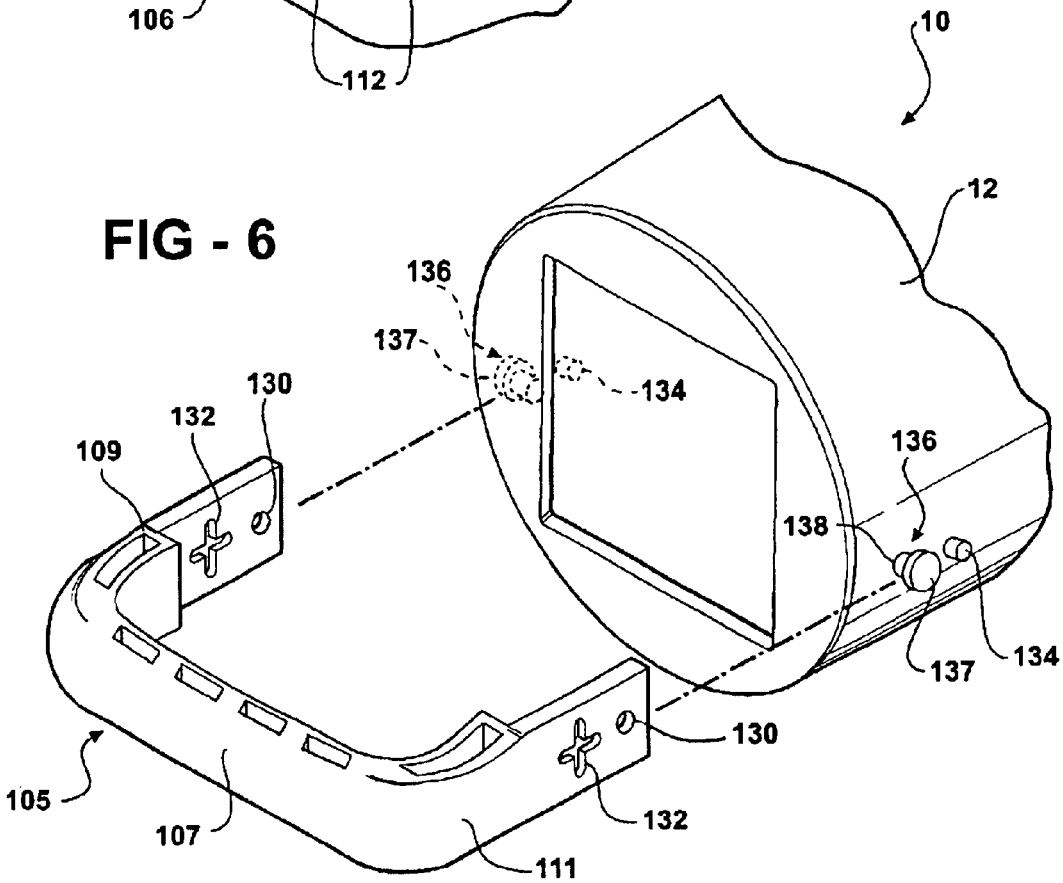
FIG. 6 is an exploded perspective view of yet another aspect of a watthour meter cover handle apparatus according to the present invention.

FIG. 6 depicts a similar handle apparatus according to the present invention. However, in this aspect, the receiver engagement members are in the form of a circular aperture 130 and a cross-shaped slot 132 located adjacent the ends of each of the side legs 109 and 111.

The handle receivers, in this aspect of the invention, include at least one and preferably a pair of projections 134 and 136, diametrically spaced on opposite sides of the sidewall 12 of the cover 10, generally adjacent to the end wall 28. Each pair of projections 134 and 136 includes a generally cylindrical projection 134 and a second projection having an enlarged head 137 on a smaller diameter shank 138.

During connection of the handle 105 to the cover 10 in this aspect of the invention, the side legs 109 and 111 are urged past the pair of projections 134 and 136 on the cover 10 until the apertures 130 and 132 can slidably engage the cylindrical projections 134 and 136. In this position, the center portion of the cross-like slots 132 in each of the side legs 109 and 111 will be positioned over and can slide past the enlarged head 137 until the slot 132 slides over the smaller diameter shanks 138. The grip 107 can then be urged slightly outward with respect to the end wall 28 of the cover 10 so that the shanks 138 slide into a smaller end portion of each of the cross-shaped slots 132 and 136. It should be noted that the diameter of the apertures 130 is chosen to allow some longitudinal movement of the handle 105 relative to the cover 10.

A simple opposite sequence is employed to separate the handle 105 from the cover 10. A laterally outward directed force is required to separate the ends of the side legs 109 and 111 from the pairs of projections 134 and 136 on the cover 10.

Figure 7:
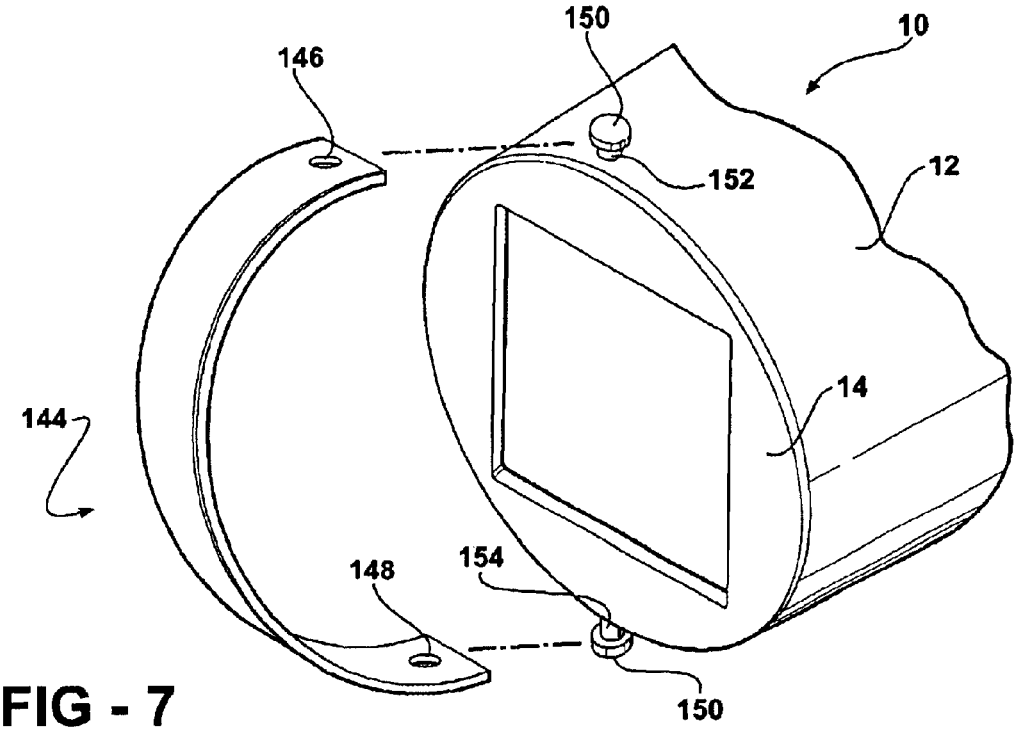
FIG. 7 is an exploded perspective view of yet another aspect of a watthour meter cover handle apparatus according to the present invention.

Yet another aspect of a handle apparatus according to the present invention is shown in FIG. 7. In this aspect, the handle 144 is in the form of a flexible strap having apertures 146 and 148 at opposite ends. Each of the apertures 146 and 148 has a diameter sized to slide over an enlarged head 150 of one of a pair of projections 152 which are mounted on diametrically opposed portions on the sidewall 12 of the cover 10 adjacent to the end wall 28. It will be understood that although the projections 152 and 154 are depicted as being at the twelve o'clock and the six o'clock positions on the cover 10 in FIG. 7, the projections 152 and 154 can also be at the three o'clock and nine o'clock position or at any other angular position on the cover 10.

In operation, the handle 144 is positioned adjacent to the end wall 28 and the apertures 146 and 148 urged over the enlarged heads 150 of each of the projections 152 and 154. The handle 144 can then be pulled outward from the end wall 28 to lock the projections 146 and 148 about the smaller diameter shanks or projections 152 and 154. The user can then exert the necessary outward pulling force on the handle 144 to separate the meter from the meter socket.

Figure 8:
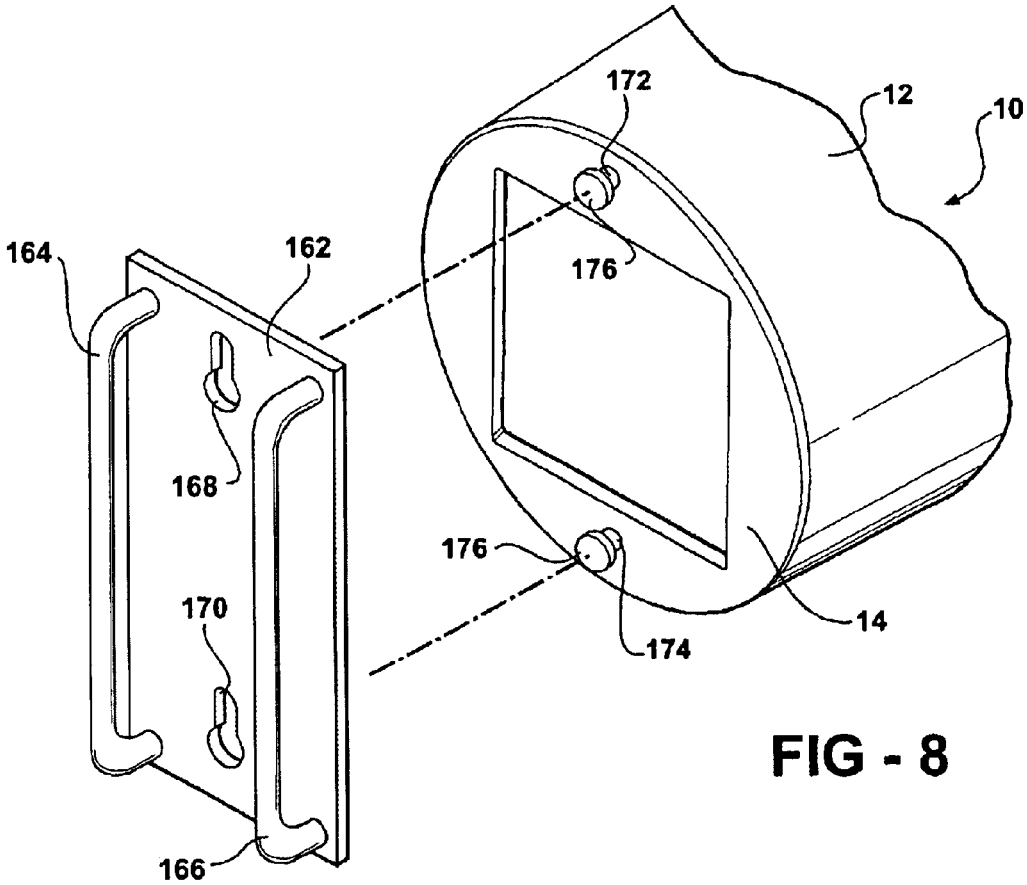
FIG. 8 is an exploded perspective view of yet another aspect of a watthour meter cover handle apparatus according to the present invention.

Another aspect of a handle apparatus of the present invention is shown in FIG. 8. In this aspect, the handle 160 is in the form of a plate 162 having a pair of side mounted hand grips 164 and 166. Each of the hand grips 164 and 166 is formed of a bar having a central portion and two side legs joined to and extending from the plate 162. The receiver engagement members are at least one and preferably a pair of key-hole slots 168 and 170 in the plate 162. The slots 168 and 170 are adapted to be aligned with the handle receiver formed on the cover 10 which are generally in the form of a pair of spaced projections or pins 172 and 174, each having an enlarged head 176. The enlarged heads 176 are adapted to receive the enlarged diameter portion of each key-hole slot 166 and 170 to bring the plate 162 into engagement with the end wall 28 of the cover 10. The plate 162 is then urged downward in the orientation shown in FIG. 8 bringing the smaller diameter or cross-section of each of the key-hole slots 166 and 170 into engagement with the smaller diameter pin portion of each of the projections 172 and 174 thereby fixing the plate 162 on the end wall 14 of the cover 10. The user can then exert an outward pulling force via the grips 164 and 166 to remove the meter from the meter socket. The same mounting of the handle 160 on the end wall 28 of the cover 10 can be used to exert an inward insertion force to forcibly mount the meter in a meter socket or meter socket adapter.

Figure 9:
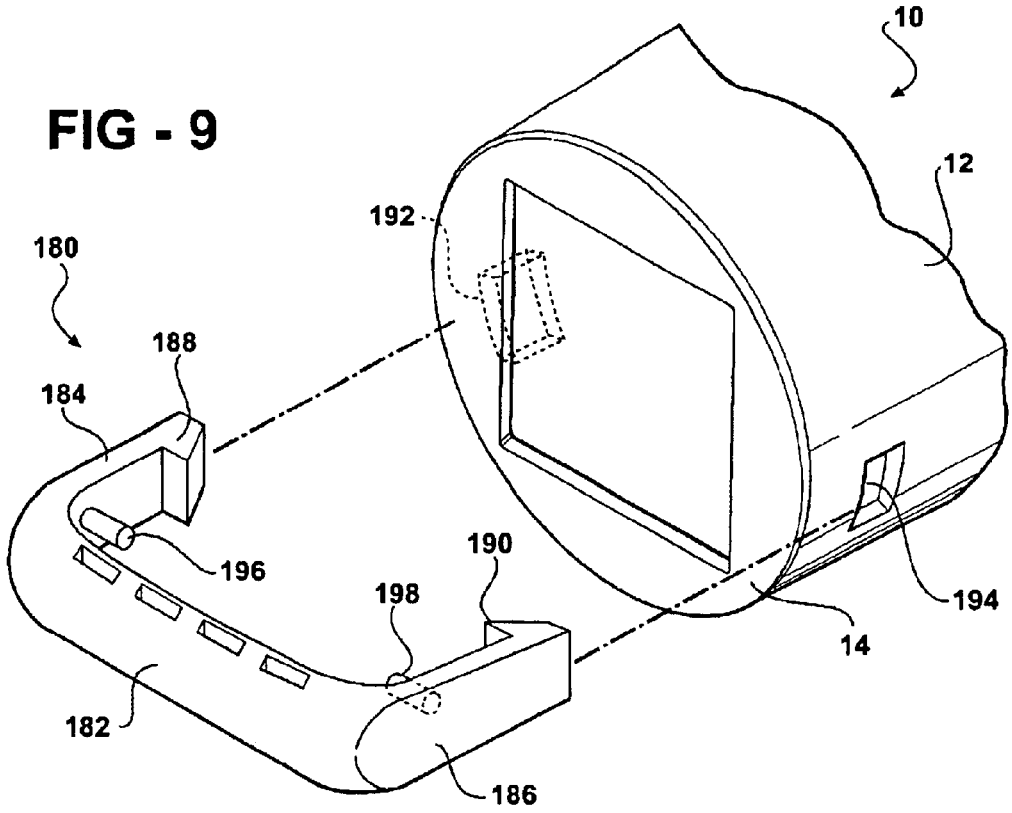
FIG. 9 is an exploded perspective view of yet another aspect of a watthour meter cover handle apparatus according to the present invention.
Figure 10:
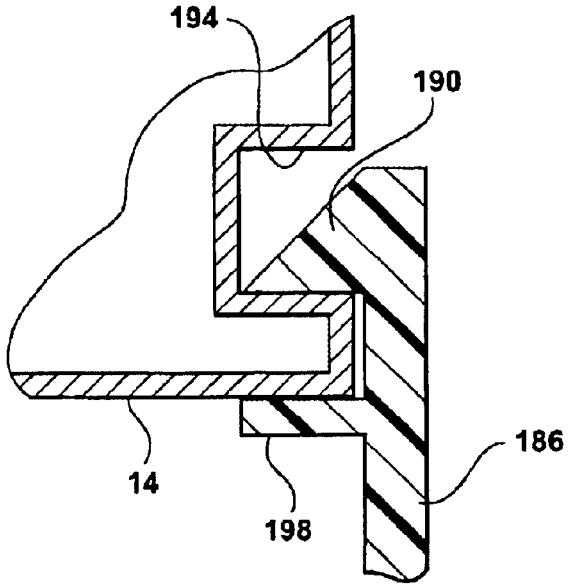
FIG. 10 is a cross-sectional view showing the mounting of the handle end in the cover recess depicted in FIG. 9.

In the aspect of the invention shown in FIGS. 9 and 10, a handle 180 includes a central grip portion 182 and two side legs 184 and 186 extending generally perpendicular from opposite ends thereof. Each of the side legs 184 and 186 terminates in an inward extending enlargement or hook 188 and 190, respectively. The enlarged ends 188 and 190 are sized to fit into and releasably latch in complimentary shaped receiver recesses 192 and 194, respectively, formed in the sidewall 12 of the cover 10, spaced a short distance from the end wall 14.

A limit stop pin 196 and 198, is mounted on an inner surface of each of the side legs 184 and 186 and spaced from the associated inward projection 188 or 190, respectively, to limit sliding insertion of the handle 180 relative to the cover 10. At the same time, the limit stop pins 196 and 198 exert a biasing force on the side legs 184 and 186 to maintain the enlarged end portions 188 and 190 in the recesses 192 and 194.

An outward force may be exerted on the ends of each of the side legs 184 and 186 to separate the enlarged ends 188 and 190 from the recesses 192 and 194 to enable separation of the handle 180 from the cover 10.

Figure 11:
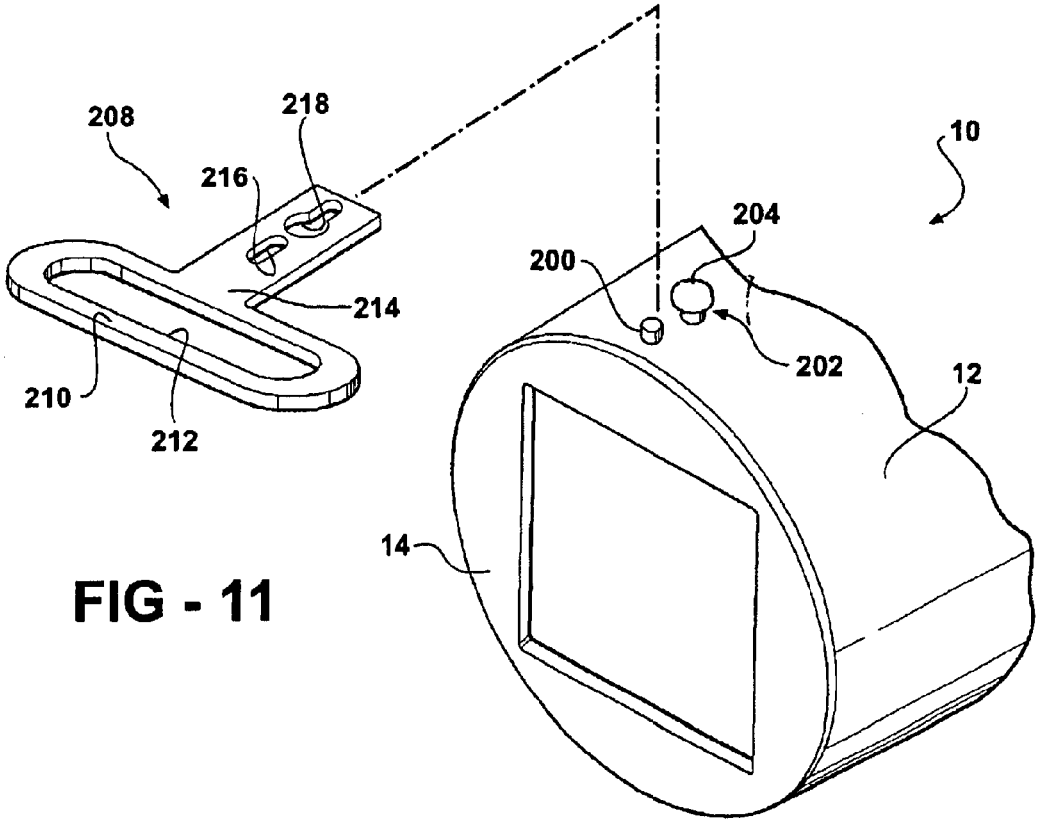
FIG. 11 is an exploded perspective view of another aspect of a watthour meter cover handle apparatus according to the present invention.

Referring now to FIG. 11, in this aspect of the present invention the handle receiver is in the form of a pair of projections, including a generally cylindrical pin-like shaped projection 200 and a projection 202 having a constant diameter shank which terminates in an enlarged head 204. The projections 200 and 202 are mounted in any suitable position on the sidewall 12 closely spaced from the end wall 28. A mounting advantage can be obtained if the projections 200 and 202 are mounted at the twelve o'clock position for the normal mounting position of the cover 10 on a meter socket.

In this aspect of the invention, a handle 208 includes a bar-shaped member 210 having a slot-shaped aperture 212 forming a finger grip along one edge of the bar-shaped member 210. An elongated stem 214 extends from the bar-shaped member 210. Apertures 216 and 218 are formed in the stem 214 and are complimentary shaped to the projections 200 and 202, respectively, so as to be slidably received thereover and longitudinally shifted to lock the handle 208 to the cover 10.

In operation, the handle 208 is moved toward the cover 10 until the apertures 216 and 218 are aligned with the projections 200 and 202, respectively. The stem 214 is then dropped over the projections 200 and 202 such that the projections 200 and 202 slide through the apertures 216 and 218, respectively. It should be noted that the enlarged end portion of the key-hole shaped slot forming the aperture 218 is sized to receive the enlarged head 204 of the projection 202. The handle 208 is then shifted longitudinally outward with respect to the end wall 28 to bring the smaller diameter shaft of the projection 202 into engagement with the smaller width section of the slot or aperture 218. This locks the handle 208 to the cover 10 for removal of the watthour meter from a meter socket.

A reverse sliding movement of the handle 208 toward the end wall 28 is used to allow separation of the handle 208 from the cover 10.

Figure 12:
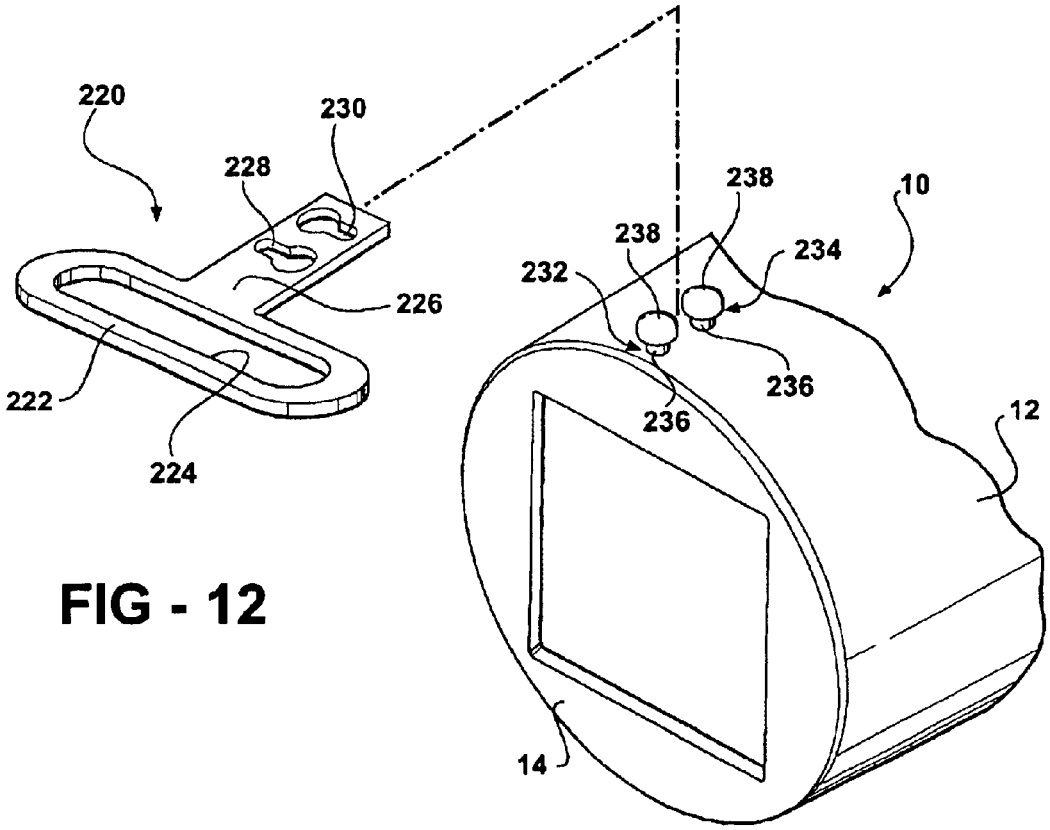
FIG. 12 is an exploded perspective view of yet another aspect of a watthour meter cover handle apparatus according to the present invention.

In FIG. 12, a handle 220 has a shape similar to the handle 208 shown in FIG. 11 in that it includes a bar-shaped member 222 with an elongated, slot-like aperture 224 which forms a finger grip on one side of the bar-shaped member 222. A stem 226 extends from the bar member 222 and includes a pair of oppositely extending apertures, each in the form of oppositely directed key-hole slots 228 and 230.

The handle receiver, in this aspect of the invention, is in the form of two projections 232 and 234, each having a constant diameter shank 236 which terminates in an enlarged head 238.

In operation, the handle 220 is angled relative to the cover 10 until the enlarged head 238 of each projection 232 and 234 slides through the enlarged end portion of each of the slots 228 and 230. The handle is then rotated relative to the projections 232 and 234 to move the shanks 236 of each projection 232 and 234 into the smaller diameter end portion of each key-hole slot 228 and 230 in order to lock the handle 220 to the cover.

An opposite directed rotational movement followed by a separation of the handle 220 from the cover 10 is used to remove the handle 220 from the cover 10.

Figure 13:
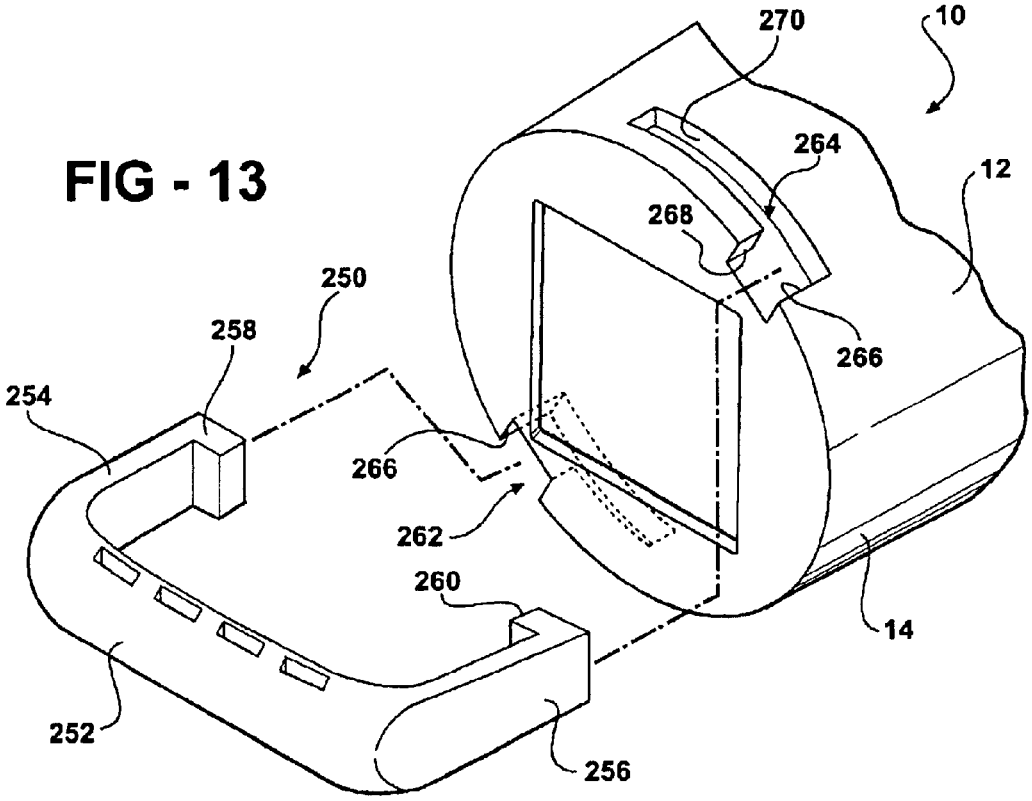
FIG. 13 is an exploded perspective view of yet another aspect of a watthour meter cover and handle apparatus according to the present invention.
Figure 14:
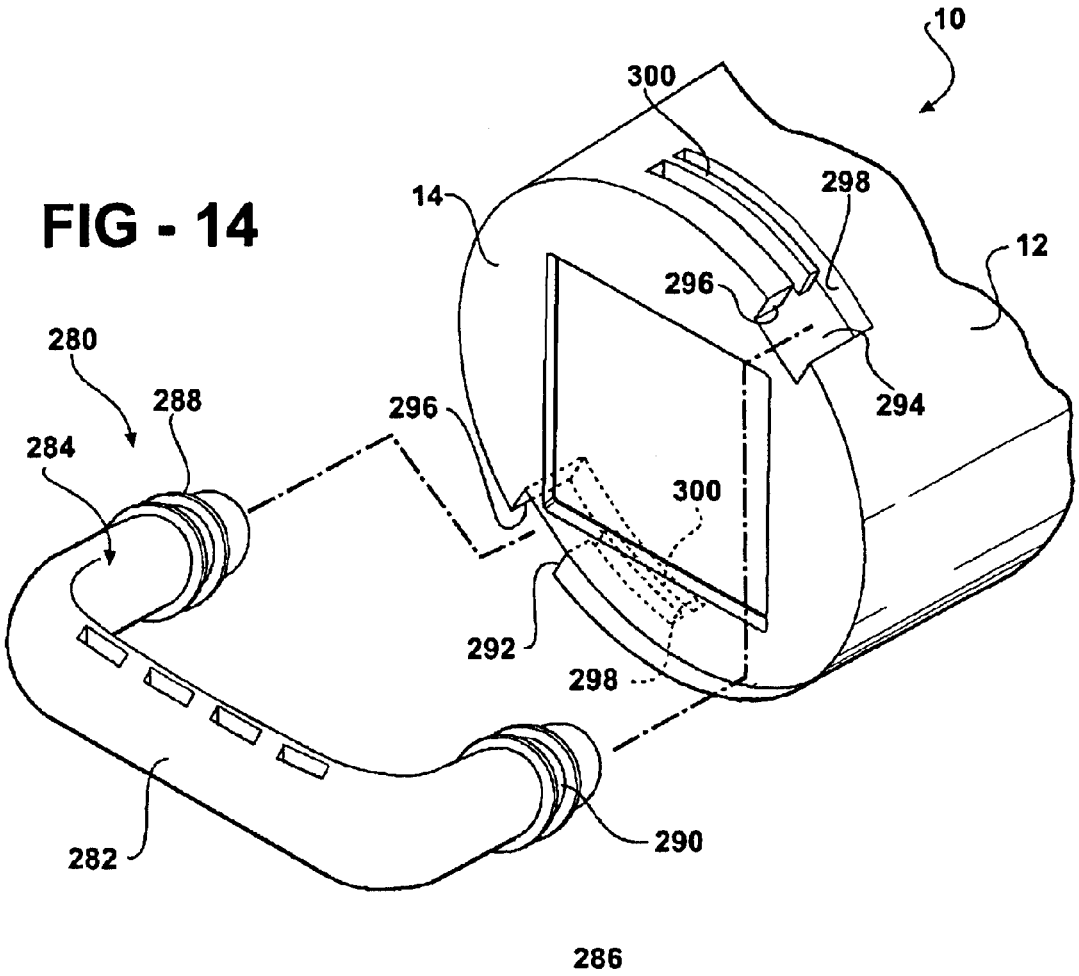
FIG. 14 is an exploded perspective view of yet another aspect of a watthour meter cover handle apparatus according to the present invention.

Referring now to FIGS. 13 and 14, there are depicted two additional aspects of the present invention which utilize rotation of the handle relative to the cover 10 to attach and remove the handle from the cover 10.

In FIG. 13, a handle 250 includes a central grip member 252 having two side legs 254 and 256 projecting angularly from opposite ends. Each side leg 254 and 256 has an inward extending projection or flange 258 and 260, respectively, carried at an outer end.

The handle receiver includes a pair of diametrically opposed recesses 262 and 264, each identically constructed and extending from an open end 266 in the end wall 28 into the sidewall 12. Each recess 262 and 264 has an L-shaped configuration formed of a first portion 268 extending longitudinally from the end 266 to the elongated, angularly disposed inner slot portion 270 extending circumferentially about the sidewall 12.

In operation, the handle 250 is advanced toward the end wall 14 of the cover 10 until the projections 258 and 260 pass through the open end 266 in the first end portion 268 of each of the recesses 262 and 264 in the cover 10. The handle 250 is inserted into the recesses 262 and 264 until the projections 258 and 260 are disposed at one end of the elongated inner portion 270 of each of the recesses 262 and 264. The handle 250 is then rotated in a counterclockwise direction, in the orientation shown in FIG. 13, by example only, causing the projections 258 and 260 to slide along the inner slot portion 270 of each of the recesses 262 and 264 until the projections 258 and 260 abut the inner end of each recess 262 and 264. This represents the locked, mounting position of the handle 250 on the cover 10. The user may then exert an outward directed force to remove the cover 10 and the attached meter from a meter socket or meter socket adapter. A reverse rotational movement followed by an outward directed pulling movement is used to remove the handle 250 from the cover 10.

Finally, in the aspect of the present invention shown in FIG. 14, a handle 280 includes a central grip member 282 and two angularly extending side legs 284 and 286. External threads 288 and 290 are formed on the ends of each of the side legs 284 and 286.

The handle receiver in this aspect of the invention includes a pair of recesses 292 and 294 which extend from an open end 296 in the end wall 28 to an angularly disposed, elongated, circumferentially extending slot portion 298. Internal threads 300 are formed along at least one side of the slot 298 in each recess 292 and 294 for threaded engagement with the threads 288 and 290 on the handle 280.

In mounting the handle 280 on the cover 10, the handle 280 is advanced toward the end wall 14 of the cover 10 until the ends of the side legs 284 and 286 pass through the open end 296 of each recess 292 and 294. The handle 280 is further inserted into each recess 292 and 294 until the threads 288 and 290 mesh with the threads 300 in each slot 298. The handle 280 is then rotated, such as in a clockwise direction in the orientation shown in FIG. 14, until the side legs 284 and 286 of the handle 280 are disposed at the inner ends of each of the slots 300. This represents the locked, mounting position of the handle 280 on the cover 10. The user can then exert an outward pulling force on the handle 280 to remove the cover 10 and the attached meter from a meter socket or meter socket adapter.

A reverse rotation movement enables the handle 280 to be unthreaded from the threads 300 in the recesses 292 and 294, followed by an outward directed pulling movement to separate the handle 280 from the cover 10.

In summary, there has been disclosed a removably attachable handle for a watthour meter cover removably attachable handles which facilitates removal and, in certain aspects, insertion of a watthour meter from and to a watthour meter socket adapter or meter socket adapter/extender. The handle has complimentary shaped receiver engagement members which engage complimentary formed receivers formed on or carried on the watthour meter cover for removable attachment of the handle to the cover. This arrangement enables a handle to be attached to a meter cover only when needed to remove and, in certain aspects, insert a meter from and to a watthour meter socket or socket adapter/extender. This also enables a single handle to be used with many watthour meter covers. Further, the handle receivers formed or carried on the cover do not interfere with the operation of the watthour meter or cover.

What is claimed is:

1. A handle apparatus for a watthour meter having a cover, the handle apparatus comprising:

a handle receiver carried on the cover; and a handle releasably attachable to the handle receiver, the handle receiver and the handle having complementary engaging portions to effect releasable slide together fixed engagement.

2. The handle apparatus of claim 1 wherein:

the handle receiver is integrally formed as a one piece member of the cover.

3. The handle apparatus of claim 1 wherein:

the handle receiver is fixedly mounted on the cover.

4. The handle apparatus of claim 1 wherein:

the handle receiver is a recess formed in the cover, the sidewalls of the recess tapering from a larger width inner portion to a smaller width outer end portion; and the handle has a complimentary shaped wedge portion to the recess for releasable engagement in the recess in an interference fit.

5. The handle apparatus of claim 1 wherein:

the handle receiver defines a recess in the cover, a projection extending from the recess; and the handle includes a mounting portion complementarity engagable with the recess, an aperture carried in the mounting portion releasably engagable with the projection.

6. The handle apparatus of claim 1 wherein:

the handle receiver defines a recess in the cover, a projection extending from the recess and the handle; and the handle includes a mounting portion complementarity engagable with the recess, an aperture formed in the other of the mounting portion of the handle and the recess.

7. The handle apparatus of claim 6 wherein the handle comprises:

a center finger pivotally attached to a grip end portion; and side fingers spaced from the center finger and slidably engagable in the recess in the cover.

8. The handle apparatus of claim 1 wherein:

the handle receiver includes an apertured flange projecting from the cover;

the handle includes a pair of side legs, each terminating in at least one bendable arm; and a hook formed on the end of each arm releasably engagable with the flange after the arm has been inserted through the aperture in the flange.

9. The handle apparatus of claim 8 wherein:

the handle receiver includes two apertured flanges; and the handle includes two arms, each having at least one hook on an end thereof.

10. The handle apparatus of claim 1 wherein:

the handle receiver includes a projection extending from opposite sides of the body; and the handle includes a grip having side legs, an aperture formed in each side leg releasably engagable with one of the projections to releasably attach the handle to the cover.

11. The handle apparatus of claim 10 wherein:

the at least one projection of the receiver comprises two longitudinally aligned projections disposed in pairs on opposite sides of the cover; and the at least one aperture in each side leg of the handle includes two apertures in each side leg.

12. The handle apparatus of claim 1 further comprising:

the handle receiver including at least one projection on the cover; and the handle includes at least one aperture releasably engagable with the projection to releasably attach the handle to the cover.

13. The handle apparatus of claim 12 wherein:

the at least one aperture on the handle comprises a keyhole shaped slot having a first narrow width end portion and a contiguous larger width second end portion; and the at least one projection having a first narrow width portion engagable with the first end portion of the slot and a second width portion engagable only with the second end portion of the slot.

14. The handle apparatus of claim 1 wherein:

the cover defining a body with a longitudinal axis extending from an end;

the handle receiver includes two aligned projections on the cover; and the handle includes two aligned apertures, each releasably engagable with one of the projections to releasably attach the handle to the cover.

15. The handle apparatus of claim 14 wherein:

the aligned projections are disposed parallel to the longitudinal axis of the cover.

16. The handle apparatus of claim 1 wherein:

the aligned projections extend at an angle to the longitudinal axis of the cover.

17. The handle apparatus of claim 1 further comprising:

the handle receiver including at least one projection carried on the end wall of the cover;

the handle including a wall having at least one aperture engagable with the at least one projection to releasably attache the handle to the end wall of the cover; and at least one hand grip carried on the wall.

18. The handle apparatus of claim 1 further comprising:

the handle receiver including projections formed on opposing portions of the cover; and the handle including a flexible strap having apertures at opposed ends releasably engagable with the projections to releasably attach the handle to the cover.

19. The handle apparatus of claim 1 further comprising:

the handle receiver including opposed recesses carried in the cover;

the handle includes a central grip member and a pair of side legs extending therefrom, each side leg carrying a projection releasably insertable into the recess to releasably attach the handle to the cover.

20. The handle apparatus of claim 19 further comprising:

a tension arm carried on each side leg and resiliently biased into engagement with the end wall of the cover when the projection on the side leg is disposed in the recess in the cover.

21. The handle apparatus of claim 1 further comprising:

the handle receiver including recesses formed on opposed portions of the cover, each recess having an inner end angularly extending from the opposed end of the recess; and the handle includes a projection engagable with the recess and rotatable into the recess to releasably attach the handle to the cover.

22. The handle apparatus of claim 1 further comprising:

the handle receiver including threads carried on the cover; and the handle including mating threads releasably engagable with the threads on the body to releasably attach the handle to the cover.

23. The handle apparatus of claim 22 further comprising:

the handle receiver including opposed thread portions on the cover; and the handle includes a pair of ends, each having a threaded portion releasably engagable with one of the threaded portions in the cover.

24. The handle apparatus of claim 1 further comprising:

the handle receiver and the handle forming cooperating complimentary snap fit connections to releasably attach the handle to the cover.

25. The handle apparatus of claim 1 wherein:

the complimentary engaging portions releasably attach the handle to the cover in a twist lock connection.

26. The handle apparatus of claim 1 further comprising:

the handle receiver and the handle having complimentary threaded portions to releasably attach the handle to the cover in a threaded connection.

* * * * *